US009035631B2

(12) United States Patent
Lee

(10) Patent No.: US 9,035,631 B2
(45) Date of Patent: May 19, 2015

(54) LDO (LOW DROP OUT) HAVING PHASE MARGIN COMPENSATION MEANS AND PHASE MARGIN COMPENSATION METHOD USING THE LDO

(71) Applicant: Samsung Electro-Mechanics Co., Ltd., Gyeonggi-do (KR)

(72) Inventor: Soo Woong Lee, Gyeonggi-do (KR)

(73) Assignee: SAMSUNG ELECTRO-MECHANICS CO., LTD., Gyeonggi-Do (KR)

( * ) Notice: Subject to any disclaimer, the term of this patent is extended or adjusted under 35 U.S.C. 154(b) by 180 days.

(21) Appl. No.: 13/831,054

(22) Filed: Mar. 14, 2013

(65) Prior Publication Data

US 2013/0278233 A1 Oct. 24, 2013

(30) Foreign Application Priority Data

Apr. 23, 2012 (KR) ..... 10-2012-0042163

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
CPC ..... G05F 1/46; G05F 1/56; G05F 1/59; G05F 1/575; G05F 1/465; G05F 1/565; G05F 1/567; G05F 3/18; G05F 3/22; G05F 3/24; G05F 3/30; G05F 3/242; G05F 3/245262; G05F 3/265; H02M 3/07; H02M 3/156; H02M 3/1584; H02M 2001/0032; H02M 2001/0045
USPC ..... 323/265, 268, 269, 273, 274, 280, 323/311–313; 327/164, 172, 175
See application file for complete search history.

(56) References Cited

U.S. PATENT DOCUMENTS 6,229,289 B1 * 5/2001 Piovaccari et al. ..... 323/268
7,230,408 B1 * 6/2007 Vinn et al. ..... 323/273

(Continued)

FOREIGN PATENT DOCUMENTS

JP 2005-312141 A 11/2005
JP 2006-204090 A 8/2006

(Continued)

*Primary Examiner* — Matthew Nguyen
*Assistant Examiner* — Kevin H Sprenger
(74) *Attorney, Agent, or Firm* — Bracewell & Giuliani LLP; Brad Y. Chin

(57) ABSTRACT

The phase margin compensation method according to an exemplary embodiment of the present invention includes: outputting reference voltage (Vout2); outputting a first reference voltage (Vout1) actually supplied to the target circuit; comparing the reference voltage (Vout2) with the first reference voltage (Vout1) by the comparator; counting any section of an output signal (pulse signal) from the comparator by a predetermined frequency by the duty cycle calculator; and controlling a phase margin of a frequency of output voltage supplied to the target circuit by controlling buffer current based on the duty cycle ratios and the output bit information fed back from the duty cycle calculator.

12 Claims, 8 Drawing Sheets

(56) References Cited

U.S. PATENT DOCUMENTS

| | | | | |
|---|---|---|---|---|
| 7,508,176 | B2 * | 3/2009 | Hartular et al. | 323/268 |
| 7,508,177 | B2 * | 3/2009 | Aiura et al. | 323/268 |
| 7,701,181 | B2 * | 4/2010 | Inoue | 323/268 |
| 7,843,180 | B1 | 11/2010 | Cilingiroglu | |
| 8,154,263 | B1 * | 4/2012 | Shi et al. | 323/269 |
| 2006/0158165 | A1 * | 7/2006 | Inn et al. | 323/280 |
| 2012/0262135 | A1 * | 10/2012 | Childs | 323/269 |
| 2013/0015828 | A1 * | 1/2013 | Amir | 323/281 |

FOREIGN PATENT DOCUMENTS

| | | | |
|---|---|---|---|
| KR | 10-2008-0017829 | A | 2/2008 |
| KR | 1020090028282 | | 3/2009 |
| KR | 10-2010-0074421 | A | 7/2010 |

* cited by examiner

- PRIOR ART -

- PRIOR ART -

- PRIOR ART -

- PRIOR ART -

400

LDO (LOW DROP OUT) HAVING PHASE MARGIN COMPENSATION MEANS AND PHASE MARGIN COMPENSATION METHOD USING THE LDO

CROSS REFERENCE(S) TO RELATED APPLICATIONS

This application claims the benefit under 35 U.S.C. Section 119 of Korean Patent Application Serial No. 10-2012-0042163, entitled "LDO (Low Drop Out) Having Phase Margin Compensation Means And Phase Margin Compensation Method Using The LDO" filed on Apr. 23, 2012, which is hereby incorporated by reference in its entirety into this application.

BACKGROUND OF THE INVENTION

1. Technical Field

The present invention relates to a low drop out regulator (LDO), and more particularly, to an LDO having a phase margin compensation means capable of minimizing a change in output voltage of the LDO due to external environment factors by compensating for a phase margin in a circuit and a phase margin compensation method using the LDO.

2. Description of the Related Art

In designing an electronic circuit system, one of the important decisions relates to a determination of a power supply voltage level. Optimized power supply voltage levels are different for each system. Therefore, a need exists for a circuit converting external power supply voltage into internal power supply voltage having a specific value. A circuit used for the above purpose is a regulator. In particular, the regulator having a small difference between input voltage and output voltage small is referred to as low drop out (LDO). The above-mentioned LDO is often used in a circuit having a small difference between the input voltage and the output voltage. Performance indexes evaluating the LDO may include "Line Regulation," "Load Regulation," "Power Supply Rejection Ratio (PSRR)," "Efficiency," and the like. The performance indexes described above may be represented by the following Equation.

$$\text{Line_Regulation} = \frac{\Delta Vo}{\Delta Vi}$$

$$\text{Load_Regulation} = \frac{\Delta Vo}{\Delta Io}$$

$$PSRR = \frac{Vo,\ \text{ripple}}{Vi,\ \text{ripple}}$$

$$\text{Efficiency} = \frac{Io \cdot Vo}{(Io + Iq)Vi} \times 100$$

As can be appreciated from the above Equation, the equation related to the LDO is related to how stably the characteristics of the output voltage appear. That is, good line regulation may correspond to a case in which a change in the output voltage with respect to a change in the input voltage is small and good load regulation may correspond to a case in which the change in the output voltage is small even though load current is changed.

In addition, good PSRR characteristics may correspond to a case in which a ripple minimally appears in an output even though an input ripple is present and good efficiency may correspond to a case in which quiescent current (Iq) is small and the difference between the input voltage and the output voltage is small if it is assumed that Vo<Vi. That is, as can be appreciated from the above Equations, making the output voltage so as to be less affected by external environment may be the most important role of the LDO.

FIG. 1 is a diagram schematically showing a configuration of a general LDO.

As shown in FIG. 1, a general LDO 100 includes several parameters such as an operational amplifier 101, a transistor (FET) 102, resistors 103 and 104, and the like, wherein the parameters are set so that the LDO 100 indicate the accurate output voltage and is operated in a stable region. In particular, the LDO 100 is a circuit having high oscillation possibility and thus, a gain margin and a phase margin need to be carefully checked. Here, the gain margin and the phase margin will be described additionally.

FIG. 2 is a diagram graphically describing the gain margin and the phase margin.

As shown in FIG. 2, the phase margin (see FIG. 2B) means a difference between a point having a gain of 0 and a point having a phase changed of 180° at a frequency having a gain of 0. In a feedback system, changing a phase of 180° means that a circuit may be unstable accordingly. Therefore, as the difference is increased, it may be determined that the phase margin is present, which means that the circuit is stable accordingly. FIG. 2A shows the gain margin.

FIG. 3 is a diagram showing an example of a frequency response of the LDO.

Referring to FIG. 3, the frequency response of the system is determined by pole and zero, such that the stability and instability of the system are determined. The phase margin at a frequency unity gain frequency (UFG) having a gain of 0 dB is confirmed. When the phase margin is less than a reference, the system may be considered to be in an unstable region and when the phase margin is higher than a reference, the system can be considered to be operated in a stable region. The reference of the phase margin is generally considered to be about 60°. That is, when the phase margin is designed to be 60° or more, the system may be stable and may be beyond the risk of oscillation.

SUMMARY OF THE INVENTION

An object of the present invention is to provide an LDO having a phase margin compensation means and a phase margin compensation method using the same capable of minimizing a change in output voltage of the LDO due to external environment factors by comparing voltage actually supplied to a circuit with reference voltage and adjusting supply voltage (output voltage) by feed-backing the supply voltage of the LDO to a supply voltage output unit of the LDO.

According to an exemplary embodiment of the present invention, there is provided an LDO having a phase margin compensation means including a duty cycle calculator, including: a power supply unit supplying reference voltage Vref as stabled power of which the voltage level is not changed according to temperature and external environment; a reference voltage generation unit dropping the reference voltage Vref supplied from the power supply unit and outputting reference voltage Vout2 to be applied to a target circuit; a supply voltage output unit dropping the reference voltage Vref supplied from the power supply unit to output Vout1 actually supplied to the target circuit and controlling a phase margin by controlling buffer current based on duty cycle ratios and output bit information fedback from an output end; a comparator comparing the reference voltage Vout2 output from the reference voltage generation unit with the supply voltage Vout1 output from the supply voltage output unit to check whether the supply voltage Vout1 is oscillated and output a pulse signal according to the oscillation of the supply voltage Vout1; and a duty cycle calculator receiving an output signal (pulse signal) from the comparator to count any section of the output signal (pulse signal) by a predetermined frequency, thereby obtaining the duty cycle ratios and output bits according to the counting and feedbacking the information to the supply voltage output unit.

The power supply unit may be a band gap reference (BGR) voltage generator.

The supply voltage output unit may include: an operational amplifier having an non-inverting input terminal connected to the power supply unit and an inverting input terminal connected to a common connection node of two serially connected resistors connected to a source terminal of a MOSFET and dropping the reference voltage Vref supplied from the power supply unit to output the voltage Vout1 actually supplied to the target circuit; a buffer having an input terminal connected to an output end of the operational amplifier and an output terminal connected to a gate terminal of the MOSFET and feedback-receiving the duty cycle ratios and the output bit information from the duty cycle calculator to control current; and a MOSFET having a drain terminal connected to an external DC power supply, a gate terminal connected to an output terminal of the buffer, and a source terminal connected to a ground via the two serially connected resistors to supply an output from the buffer to the gate terminal so as to be switching-operated, thereby outputting or interrupting the actual supply voltage Vout1 to and from the target circuit.

The duty cycle calculator may count any section of the output signal (pulse signal) of the comparator by a predetermined frequency to calculate the number of pulse values that is output as high, obtain the duty cycle ratios, respectively, according to the number of calculated high pulses, and allocate the output bits (digital bits), respectively, in response to the obtained duty cycle ratios The duty cycle ratios may be obtained by being divided into 0 to 12.5%, 12.5 to 25%, 25 to 37.5%, and 37.5 to 50% according to the number of calculated high pulses, respectively.

The output bit (digital bit) may be allocated as "00" when the duty cycle ratio is 0 to 12.5%, "01" when the duty cycle ratio is 12.5 to 25%, "10" when the duty cycle ratio is 25 to 37.5%, and "11" when the duty cycle ratio is 37.5 to 50%, respectively.

According to another exemplary embodiment of the present invention, there is provided a phase margin compensation method using an LDO having a phase margin compensation means including a power supply unit, a reference voltage generation unit, a supply voltage output unit, a comparator, and a duty cycle calculator, the phase margin compensation method includes: a) outputting voltage Vout2 to be applied to a target circuit by receiving and dropping reference voltage Vref as power from the power supply unit by the reference voltage generation unit; b) outputting voltage Vout1 actually supplied to the target circuit by receiving and dropping the reference voltage Vref as power from the power supply unit by the supply voltage output unit; c) comparing the reference voltage Vout2 output from the reference voltage generation unit with the supply voltage Vout1 output from the supply voltage output unit by the comparator to check whether the supply voltage Vout1 is oscillated and output a pulse signal according to the oscillation of the supply voltage Vout1; d) receiving an output signal (pulse signal) from the comparator to count any section of the output signal (pulse signal) by a predetermined frequency by the duty cycle calculator, thereby obtaining the duty cycle ratios and output bits according to the counting and feedbacking the information to the supply voltage output unit; and e) controlling a phase margin of a frequency of output voltage supplied to the target circuit by feedback-receiving the duty cycle ratios and the output bit information from the duty cycle calculator by the supply voltage output unit and controlling the buffer current based thereon.

In step d), any section of the output signal (pulse signal) of the comparator by the duty cycle calculator may be counted by a predetermined frequency to calculate the number of pulse values that is output as high, the duty cycle ratios may each be obtained according to the number of calculated high pulses, and the digital bits may each be allocated in response to the obtained duty cycle ratios.

The duty cycle ratios may be obtained by being divided into 0 to 12.5%, 12.5 to 25%, 25 to 37.5%, and 37.5 to 50% according to the number of calculated high pulses, respectively.

The digital bit may be allocated as "00" when the duty cycle ratio is 0 to 12.5%, "01" when the duty cycle ratio is 12.5 to 25%, "10" when the duty cycle ratio is 25 to 37.5%, and "11" when the duty cycle ratio is 37.5 to 50%, respectively.

In step e), the phase margin of the frequency of the output voltage supplied to the target circuit may be controlled by feedback-receiving the digital bit information from the duty cycle calculator by the supply voltage output unit, setting the corresponding buffer current values according to the digital bits, and controlling the buffer current based on each of the set buffer current values.

The buffer current values may be set as $I_{buf}$ that is a basic buffer current value when the digital bit is "00", $1.5\times I_{buf}$ when the digital bit is "01", $2\times I_{buf}$ when the digital bit is "10", and $4\times I_{buf}$ when the digital bit is "11", respectively.

DESCRIPTION OF THE PREFERRED EMBODIMENTS

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention.

Throughout the specification, unless explicitly described otherwise, "comprising" any components will be understood to imply the inclusion of other components but not the exclusion of any other components. In addition, a term "part", "module", "unit", or the like, described in the specification means a unit of processing at least one function or operation and may be implemented by hardware or software or a combination of hardware and software.

Hereinafter, exemplary embodiments of the present invention will be described with reference to the accompanying drawings.

Figure 1:
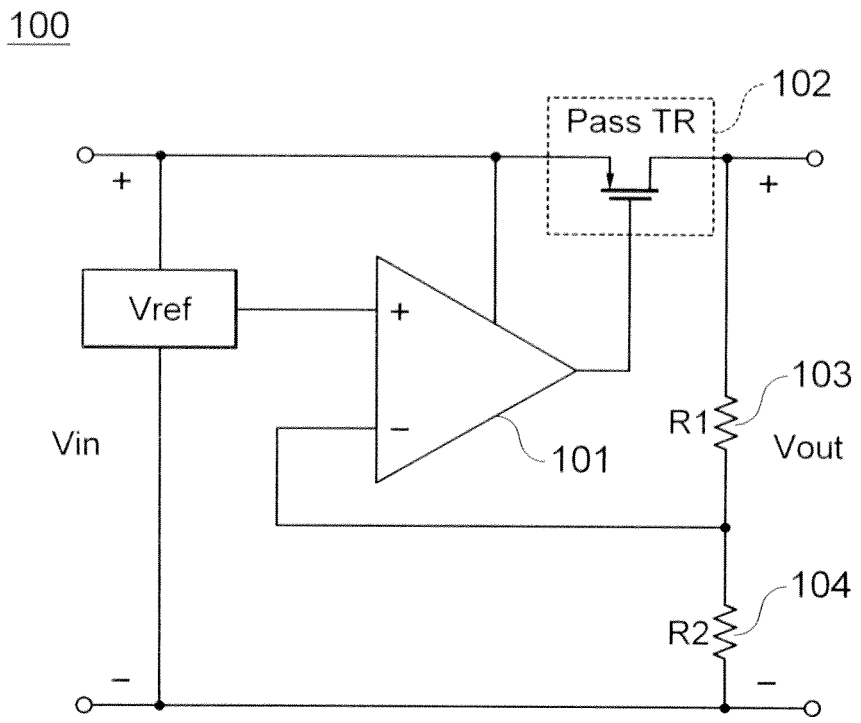
FIG. 1 is a diagram schematically showing a configuration of a general LDO.
Figure 2A:
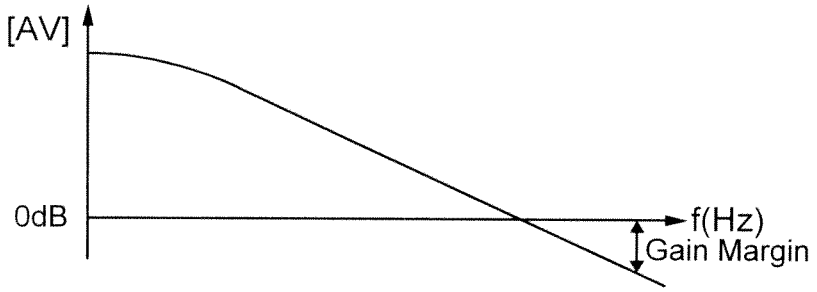
FIGS. 2A and 2B are diagrams graphically describing a gain margin and a phase margin.
Figure 2B:
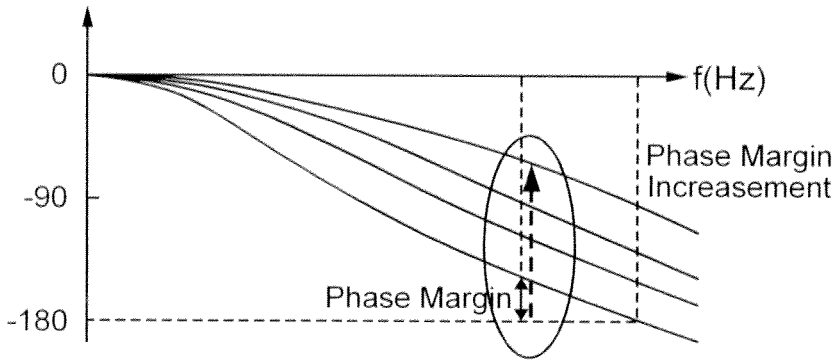
Figure 3:
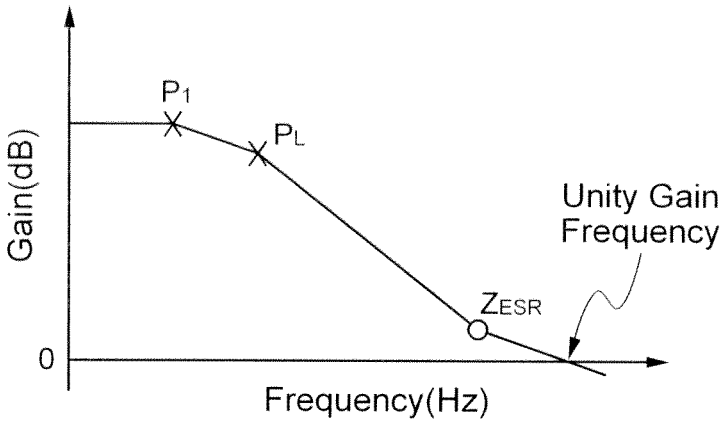
FIG. 3 is a diagram showing an example of a frequency response of the LDO.
Figure 4:
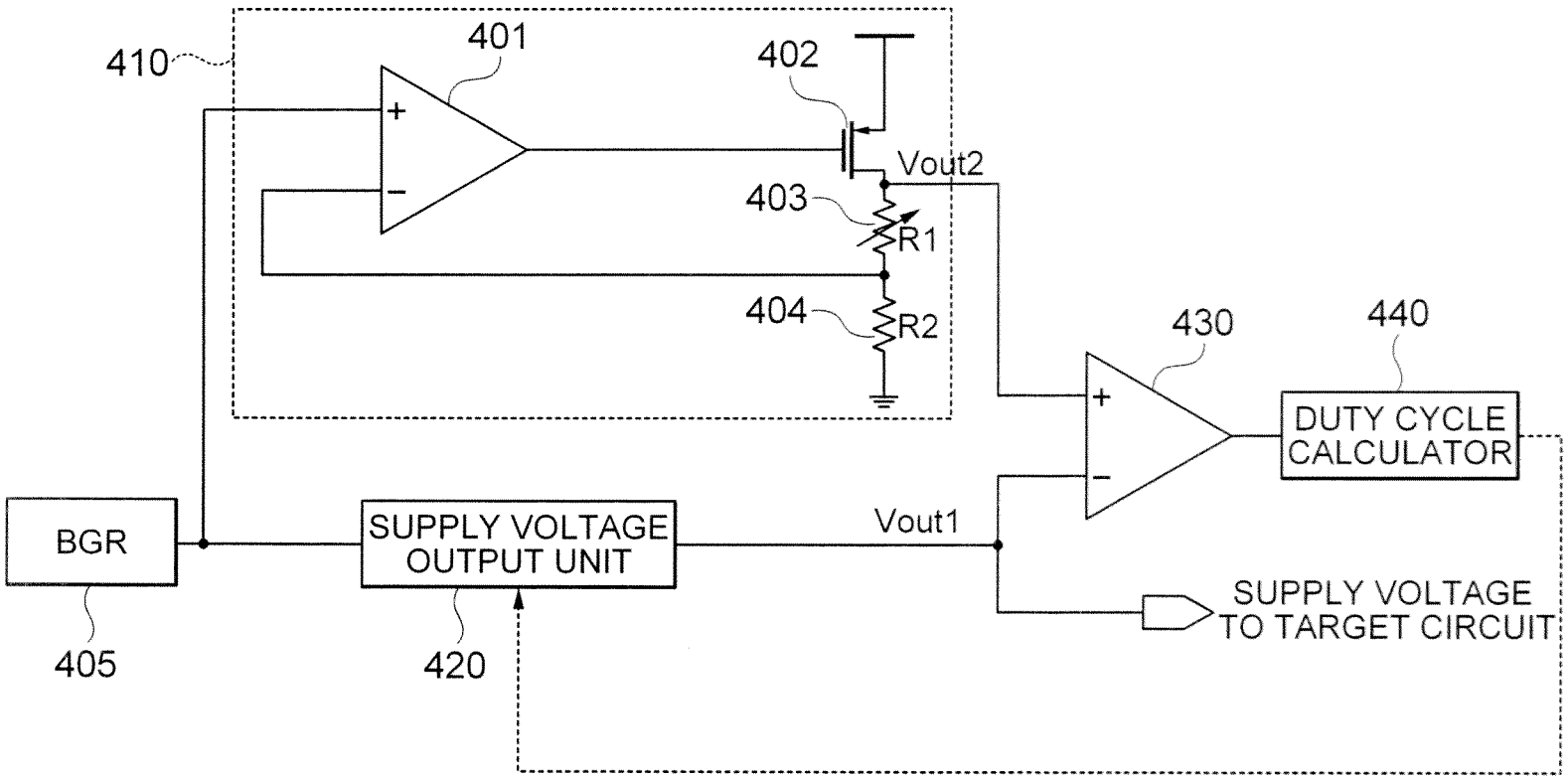
FIG. 4 is a diagram schematically showing a circuit configuration of the LDO having a phase margin compensation means according to an exemplary embodiment of the present invention.

FIG. 4 is a diagram schematically showing a circuit configuration of the LDO having a phase margin compensation means according to an exemplary embodiment of the present invention.

Referring to FIG. 4, an LDO 400 having a phase margin compensation means according to an exemplary embodiment of the present invention is configured to include a power supply unit 405, a reference voltage generation unit 410, a supply voltage output unit 420, a comparator 420, and a duty cycle calculator 440.

The power supply unit 405 supplies reference voltage Vref as stabilized power of which the voltage level is not changed according to temperature and external environment. Here, as the above power supply unit 405, a band gap reference (BGR) voltage generator may be used.

The reference voltage generation unit 410 drops the reference voltage Vref supplied from the power supply unit 405 to output reference voltage Vout 2 to be applied to a target circuit. As the above-mentioned reference voltage generation unit 410, the LDO having a general structure may be used. That is, the reference voltage generator 410 may be configured to include: an operational amplifier (OP Amp) 401 having a non-inverting input terminal connected to the power supply unit 405 and an inverting input terminal connected to a common connection node of two serially connected resistors 403 and 404 connected to a source terminal of the MOSFET 402 to drop the reference voltage Vref supplied from the power supply unit 405 and output the reference voltage Vout2 to be applied to the target circuit; a MOSFET 402 having a drain terminal connected to an external DC power supply, a gate terminal connected to an output terminal of the operational amplifier 401, and a source terminal connected to a ground via the two serially connected resistors 403 and 404 to supply an output from the operational amplifier 401 to the gate terminal so as to be switching-operated, thereby outputting and interrupting the reference voltage Vout2 to be applied to the target circuit.

The supply voltage output unit 420 drops the reference voltage Vref supplied from the power supply unit 405 to output the voltage Vout1 actually supplied to the target circuit and controls the buffer current based on the duty cycle ratios and the output bit information that are fedback from an output end (herein, the duty cycle calculator 440 to be described below), thereby controlling the phase margin.

The comparator 430 compares the reference voltage Vout2 output from the reference voltage generation unit 410 with the supply voltage Vout1 output from the supply voltage output unit 420 to check whether the supply voltage Vout1 is oscillated and output a pulse signal according to the oscillation of the supply voltage Vout1.

The duty cycle calculator 440 receives the output signal (pulse signal) from the comparator 430 to count any section of the output signal (pulse signal) by a predetermined frequency (for example 1000 times), thereby obtaining the duty cycle ratios and output bits (digital bits) according to the counting, and feedbacking the information to the supply voltage output unit 420.

Figure 5:
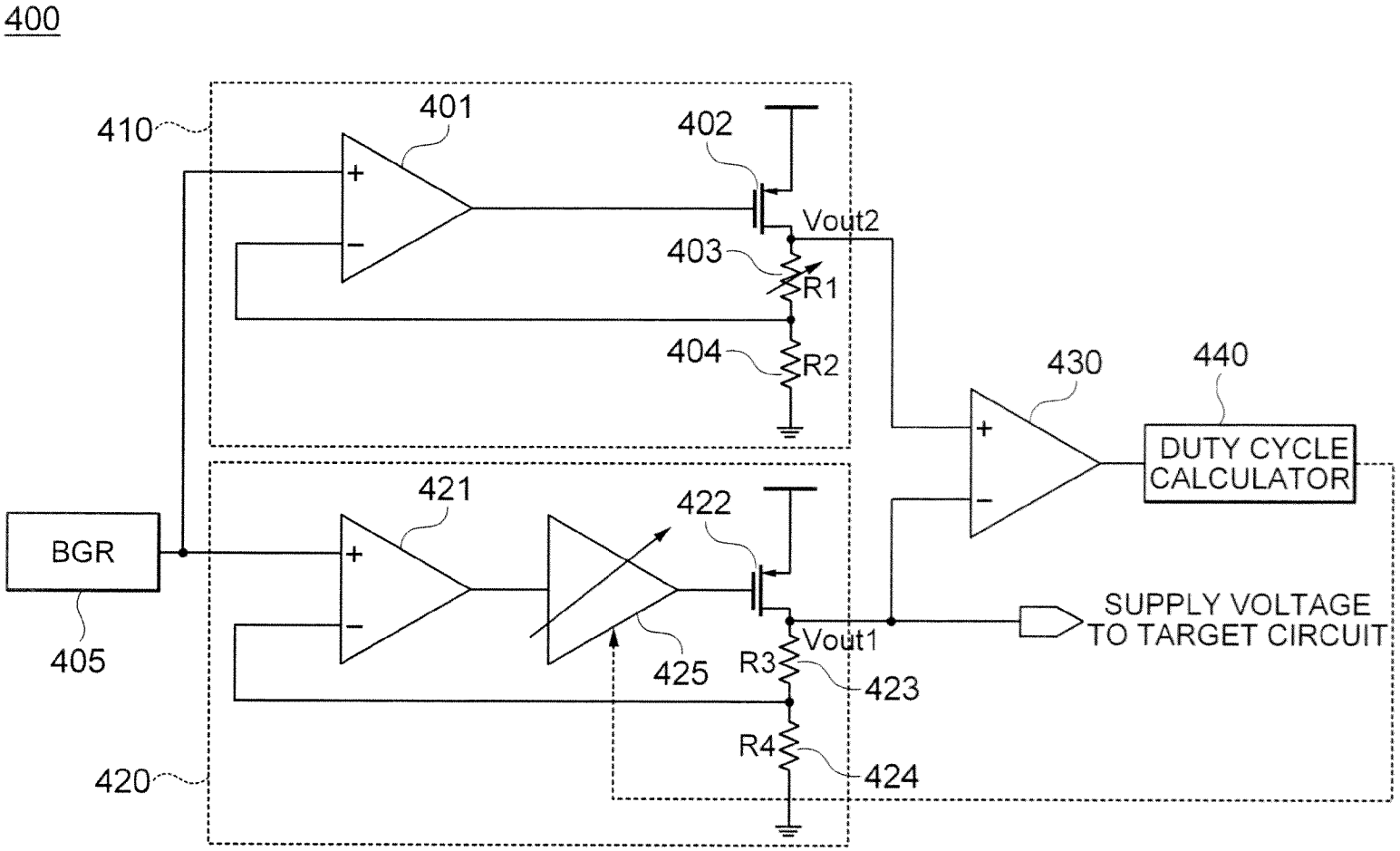
FIG. 5 is a diagram schematically showing an internal circuit configuration of a supply voltage output unit of the LDO having a phase margin compensation means according to the exemplary embodiment of the present invention.

Meanwhile, as shown in FIG. 5, the supply voltage output unit 420 may be configured to include an operational amplifier 421 having an non-inverting input terminal connected to the power supply unit 405, an inverting input terminal connected to a common connection node of two serially connected resistors 423 and 424 connected to a source terminal of a MOSFET 422 to drop the reference voltage Vref supplied from the power supply unit and output the voltage Vout1 actually supplied to the target circuit; a buffer 425 having an input terminal connected to an output end of the operational amplifier 421 and an output terminal connected to a gate terminal of the MOSFET 422 to feedback-receive the duty cycle ratios and the output bit (digital bit) information from the duty cycle calculator 440 and control current; and the MOSFET 422 having a drain terminal connected to an external DC power supply, a gate terminal connected to an output terminal of the buffer 425, and a source terminal connected to a ground via the two serially connected resistors 423 and 424 to supply an output from the buffer 425 to the gate terminal so as to be switching-operated, thereby outputting or interrupting the actual supply voltage Vout1 to and from the target circuit.

In addition, the duty cycle calculator 440 may count any section of the output signal (pulse signal) of the comparator 430 by a predetermined frequency to calculate the number of pulse values that is output as high, obtain the duty cycle ratios, respectively, according to the number of calculated high pulses, and allocate the output bits (digital bits), respectively, in response to the obtained duty cycle ratios.

In this case, the duty cycle ratios may be obtained by being divided into 0 to 12.5%, 12.5 to 25%, 25 to 37.5%, and 37.5 to 50%, respectively, according to the number of calculated high pulses.

In addition, the output bit (digital bit) may be allocated as "00" when the duty cycle ratio is 0 to 12.5%, "01" when the duty cycle ratio is 12.5 to 25%, "10" when the duty cycle ratio is 25 to 37.5%, and "11" when the duty cycle ratio is 37.5 to 50%, respectively.

The above-mentioned duty cycle ratios and digital bits will be described below.

Herein, the phase margin compensation method using the LDO having phase margin compensation means according to the exemplary embodiment of the present invention having the above-mentioned configuration will be described.

Figure 6:
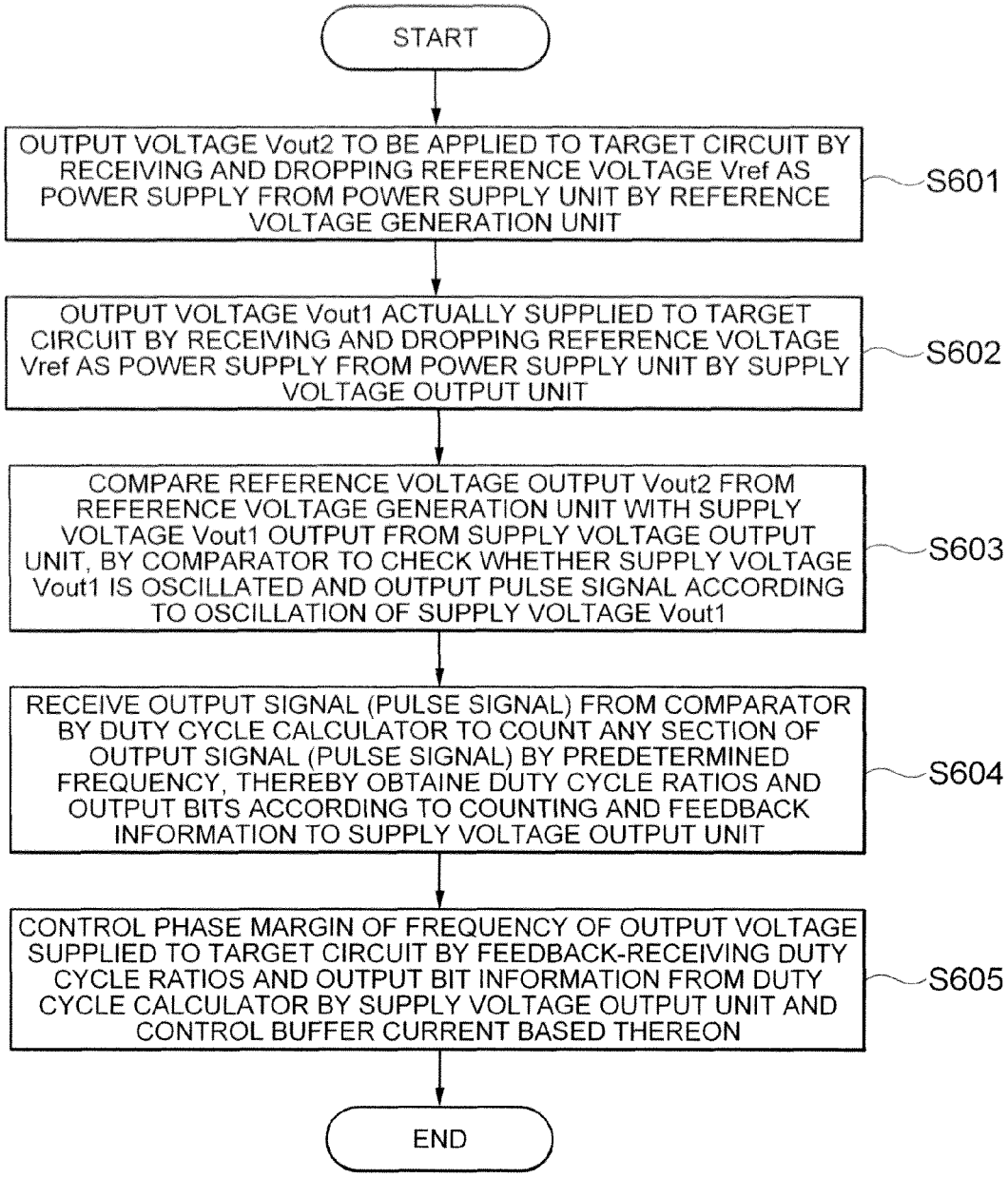
FIG. 6 is a flow chart showing a process of performing a phase margin compensation method using the LDO having a phase margin compensation means according to the exemplary embodiment of the present invention.

FIG. 6 is a flow chart showing a process of performing a phase margin compensation method using the LDO having a phase margin compensation means according to the exemplary embodiment of the present invention.

Referring to FIG. 6, the phase margin compensation method using the LDO having a phase margin compensation means according to the exemplary embodiment of the present invention is a phase margin compensation method using the LDO having a phase margin compensation means including the power supply unit 405, the reference voltage generation unit 410, the supply voltage output unit 420, the comparator 430, and the duty cycle calculator 440 as described above. First, the phase margin compensation method receives and drops the reference voltage Vref as power from the power supply unit 405 by the reference voltage generation unit 410 to output the reference voltage Vout 2 to be applied to the target circuit (S601).

In addition, the phase margin compensation method receives and drops the reference voltage Vref as power from the power supply unit 405 by the supply voltage output unit 420 to output the voltage Vout12 to be actually applied to the target circuit (S602).

Figure 7A:
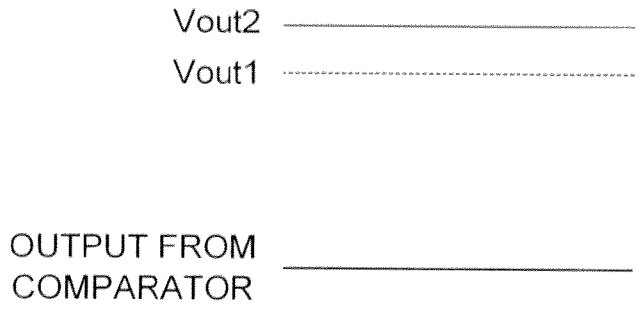
FIGS. 7A, 7B, 7C and 7D are diagrams showing an output signal with respect to an input signal of a comparator of the LDO having a phase margin compensation means according to the exemplary embodiment of the present invention.
Figure 7B:
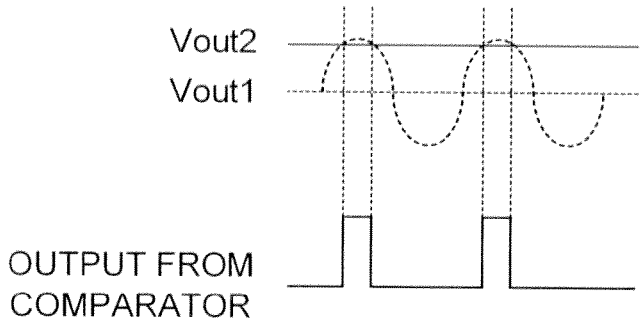
Figure 7C:
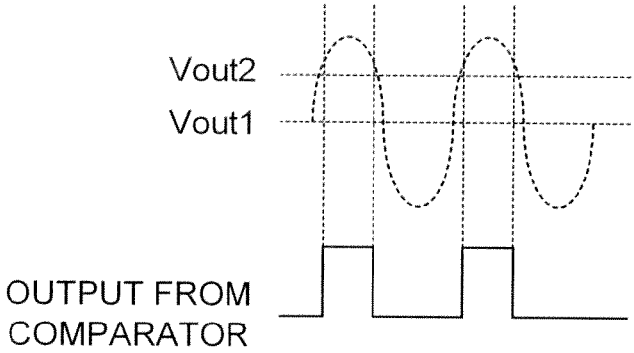
Figure 7D:
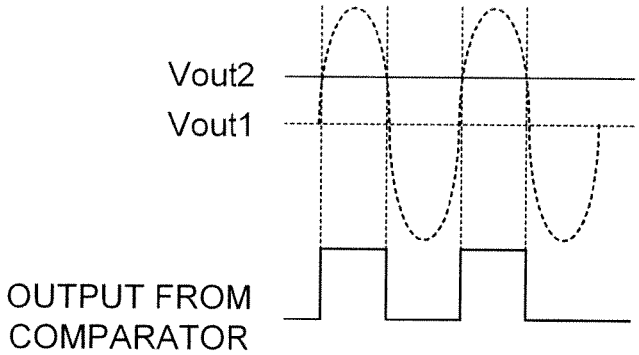

Then, the comparator 430 compares the reference voltage Vout2 output from the reference voltage generation unit 410 with the supply voltage Vout1 output from the supply voltage output unit 420 to check whether the supply voltage Vout1 is oscillated and output a pulse signal according to the oscillation of the supply voltage Vout1 (S603). That is, the comparator 430 compares voltage Vout1 with voltage Vout2. As in FIG. 7A, when the Vout1 and the Vout2 are input to the comparator 430 as the pulse signal without oscillation, the comparator 430 similarly output the pulse signal without oscillation, which means that the phase margin of the Vout1 is sufficient and thus, the LDO is normally operated. In addition, FIGS. 7B to 7D each show the cases in which the supply voltage Vout1 is oscillated. These cases mean that the phase margin of the Vout1 is not sufficient and thus, the LDO is oscillated. In particular, it can be appreciated that the oscillation is large toward (d) and thus, the output duty of the comparator 430 approximates to 50%.

Figure 8:
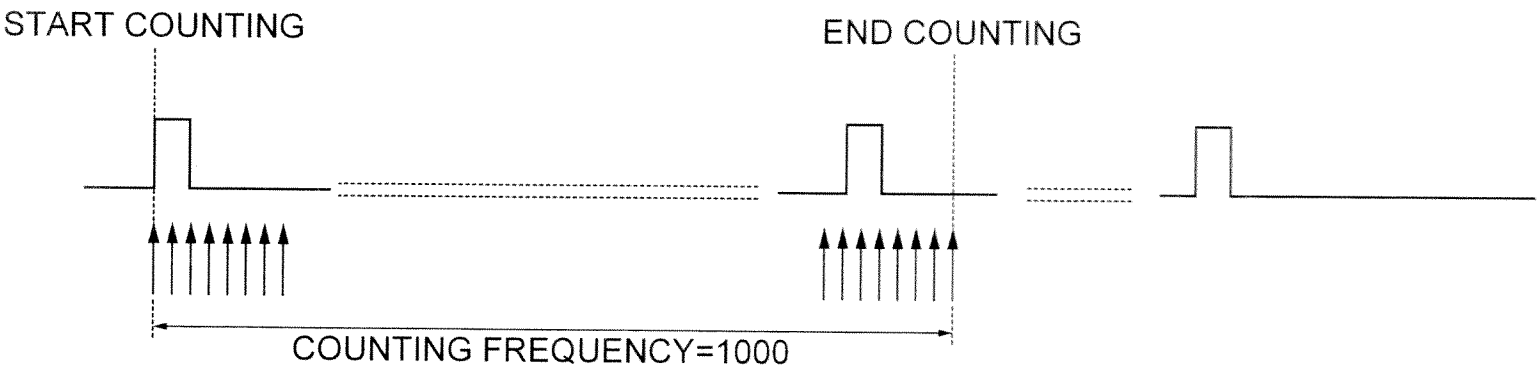
FIG. 8 is a diagram describing a process of counting any period of an output signal input from the comparator by a duty cycle calculator of the LDO having a phase margin compensation means according to the exemplary embodiment of the present invention.

As a result, when the pulse signal is output from the comparator 430 according to the oscillation of the supply voltage Vout1, as shown in FIG. 8, any section of the output signal (pulse signal) is counted by a predetermined frequency (for example, 1000 times) by receiving the output signal (pulse signal) from the comparator 430 by the duty cycle calculator 440 to obtain the duty cycle ratios and the output bits according to the counting and feedback the information to the supply voltage output unit 420 (S604). That is, the duty cycle calculator 440 may count any section of the output signal (pulse signal) of the comparator 430 by a predetermined frequency (for example, 1000 times) to calculate the number of pulse values that is output as high, obtain the duty cycle ratios, respectively, according to the number of calculated high pulses, and allocate the output bits (digital bits), respectively, in response to the obtained duty cycle ratios.

In this case, the duty cycle ratio may be obtained by being divided into 0 to 12.5% when the number of calculated high pulses is less than 125, 12.5 to 25% when the number of calculated high pulses is 125 or more or below 250, 25 to 37.5% when the number of calculated high pulses is 250 or more or below 375, and 37.5 to 50% when the number of calculated high pulses is 375 or more (below 500), respectively.

In addition, the digital bit may be allocated as "00" when the duty cycle ratio is 0 to 12.5%, "01" when the duty cycle ratio is 12.5 to 25%, "10" when the duty cycle ratio is 25 to 37.5%, and "11" when the duty cycle ratio is 37.5 to 50%, respectively. The exemplary embodiment of the present invention describes that the output bit (digital bit) is allocated as 2 bits, but is not limited to the case in which the output bit is not necessarily allocated as 2 bits. In some cases, the output bit may also be allocated as more bits (for example, 3 bits, 4 bits, and the like). Further, when increasing and allocating the number of digital bits, it is possible to more finely control the buffer current.

As described above, when the duty cycle ratios and the digital bits are obtained, the phase margin of the frequency of the output voltage supplied to the target circuit is controlled by feedback-receiving the duty cycle ratios and the output bit (digital bit) information from the duty cycle calculator 440 by the supply voltage output unit 420 and controlling the buffer current based thereon (S605).

That is, the phase margin of the frequency of the output voltage supplied to the target circuit is controlled by feedback-receiving the digital bit information from the duty cycle calculator 440 by the buffer 425 of the supply voltage output unit 420, setting the corresponding buffer current values according to the digital bits, and controlling the buffer current based on each of the set buffer current values.

Here, the buffer current values are set as $I_{buf}$ that is a basic buffer current value when the digital bit is "00," $1.5\times I_{buf}$ when the digital bit is "01", $2\times I_{buf}$ when the digital bit is "10", and $4\times I_{buf}$ when the digital bit is "11", respectively.

The following Table 1 arranges the correspondence relationship among the duty cycle ratio, the output bit (digital bit), and the buffer current as described above.

TABLE 1

| No. | Duty Cycle Ratio(%) | Output Bit (Digital Bit) | Buffer Current(μA) |
|---|---|---|---|
| 1 | 0~12.5 | 00 | $I_{buf}$ |
| 2 | 12.5~25 | 01 | $1.5 \times I_{buf}$ |
| 3 | 25~37.5 | 10 | $2 \times I_{buf}$ |
| 4 | 37.5~50 | 11 | $4 \times I_{buf}$ |

Meanwhile, FIG. 9 is a diagram showing simulation results with respect to the change in the phase margin of the LDO according to the increase in buffer current when the LDO having a phase margin compensation means according to the exemplary embodiment of the present invention is applied.

Figure 9A:
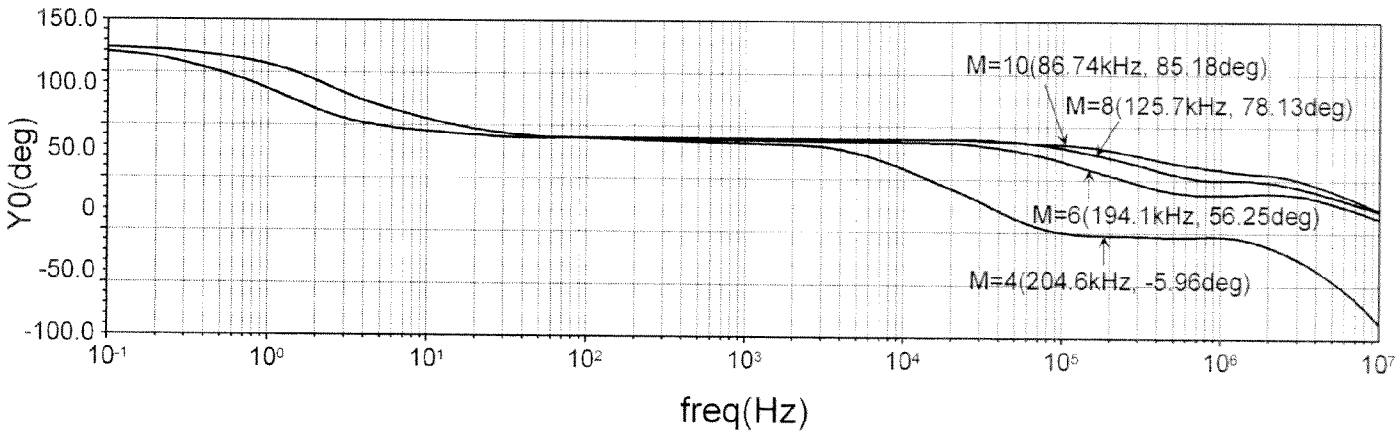
FIGS. 9A and 9B are diagrams showing simulation results with respect to a change in the phase margin of the LDO according to an increase in buffer current when the LDO having a phase margin compensation means according to the exemplary embodiment of the present invention is applied.
Figure 9B:
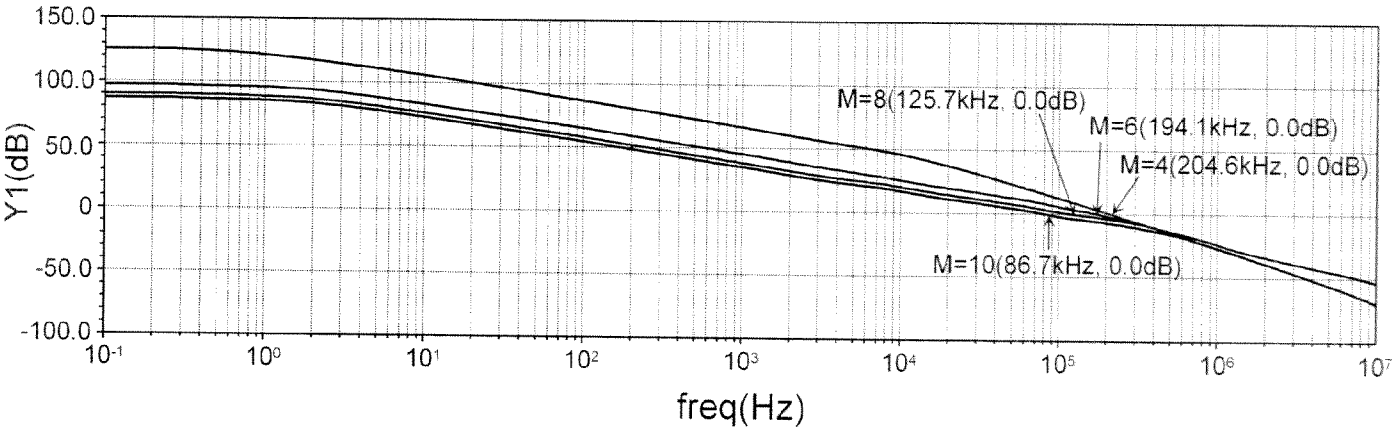

Referring to FIG. 9A, the phase margin is −5.096 deg when M=4 (when the buffer current is 40%) and thus, the operation of the LDO is very unstable, while the phase margin is 56.26 deg when M=6, 78.13 deg when M=8, and 85.18 deg when M=10 and thus, the phase margin is improved by controlling the buffer current. As a result, it can be confirmed that the operation of the LDO is stable. FIG. 9B shows the simulation results of the gain margin corresponding to the phase margin as shown in FIG. 9A.

As set forth above, the LDO having a phase margin compensation means and the phase margin compensation method using the same according to the exemplary embodiments of the present invention can control the buffer current by checking whether the output voltage of the LDO is oscillated by comparing the voltage actually supplied to the circuit with the preset reference voltage by the comparator and obtaining the duty cycle ratio and the digital bit information in response thereto by counting the pulse signal according to the oscillation by the duty cycle calculator and feed-backing the obtained duty cycle ratios and digital bit information to the supply voltage output unit of the LDO, thereby controlling the phase margin and minimizing the change in the output voltage of the LDO due to the external environment factors.

In addition, the exemplary embodiments of the present invention can design the LDO optimized for the phase margin, thereby improving the stability of the LDO that is changed by the process, temperature, and the like.

The exemplary embodiments of the present invention can control the buffer current by checking whether the output voltage of the LDO is oscillated by comparing the voltage actually supplied to the circuit with the preset reference voltage by the comparator and obtaining the duty cycle ratios and the digital bit information in response thereto by counting the pulse signal according to the oscillation by the duty cycle calculator and feed-backing the obtained duty cycle ration and digital bit information to the supply voltage output unit of the LDO, thereby controlling the phase margin and minimizing the change in the output voltage of the LDO due to the external environment factors.

In addition, the exemplary embodiments of the present invention can design the LDO optimized for the phase margin, thereby improving the stability of the LDO that is changed by the process, temperature, and the like.

The spirit of the present invention has been just exemplified. It will be appreciated by those skilled in the art that various modifications and alterations can be made without departing from the essential characteristics of the present invention. Accordingly, the embodiments disclosed in the present invention and the accompanying drawings are used not to limit but to describe the spirit of the present invention. The scope of the present invention is not limited only to the embodiments and the accompanying drawings. The protection scope of the present invention must be analyzed by the appended claims and it should be analyzed that all spirits within a scope equivalent thereto are included in the appended claims of the present invention.

What is claimed is:

1. An LDO having a phase margin compensation means including a duty cycle calculator, comprising:

a power supply unit supplying reference voltage Vref as stabled power of which the voltage level is not changed according to temperature and external environment;

a reference voltage generation unit dropping the reference voltage Vref supplied from the power supply unit and outputting reference voltage (Vout2);

a supply voltage output unit dropping the reference voltage Vref supplied from the power supply unit to output a first reference voltage (Vout1) actually supplied to the target circuit and controlling a phase margin by controlling buffer current based on duty cycle ratios and output bit information fed back from an output end;

a comparator comparing the reference voltage (Vout2) output from the reference voltage generation unit with the first reference voltage (Vout1) output from the supply voltage output unit to output a pulse signal according to comparion result of the comparator; and a duty cycle calculator receiving an output signal (pulse signal) from the comparator to count any section of the output signal (pulse signal) by a predetermined frequency, thereby obtaining the duty cycle ratios and output bits according to the counting and the duty cycle ratios and the output bit information fed back to the supply voltage output unit.

2. The LDO according to claim 1, wherein the power supply unit is a band gap reference (BGR) voltage generator.

3. The LDO according to claim 1, wherein the supply voltage output unit includes:

an operational amplifier having an non-inverting input terminal connected to the power supply unit and an inverting input terminal connected to a common connection node of two serially connected resistors connected to a source terminal of a MOSFET and dropping the reference voltage Vref supplied from the power supply unit to output the first reference voltage (Vout1) actually supplied to the target circuit;

a buffer having an input terminal connected to an output end of the operational amplifier and an output terminal connected to a gate terminal of the MOSFET and receiving the duty cycle ratios and the output bit information through feedback from the duty cycle calculator to control current; and a MOSFET having a drain terminal connected to an external DC power supply, a gate terminal connected to an output terminal of the buffer, and a source terminal connected to a ground via the two serially connected resistors to supply an output from the buffer to the gate terminal so as to be switching-operated, thereby outputting or interrupting the actual supply voltage (Vout1) to and from the target circuit.

4. The LDO according to claim 1, wherein the duty cycle calculator counts any section of the output signal (pulse signal) of the comparator by a predetermined frequency to calculate the number of pulse values that are output as high, obtains the duty cycle ratios, respectively, according to the number of calculated high pulses, and allocates the output bits (digital bits), respectively, in response to the obtained duty cycle ratios.

5. The LDO according to claim 4, wherein the duty cycle ratios are obtained by being divided into 0 to 12.5%, 12.5 to 25%, 25 to 37.5%, and 37.5 to 50% according to the number of calculated high pulses, respectively.

6. The LDO according to claim 4, wherein the output bit (digital bit) is allocated as "00" when the duty cycle ratio is 0 to 12.5%, "01" when the duty cycle ratio is 12.5 to 25%, "10" when the duty cycle ratio is 25 to 37.5%, and "11" when the duty cycle ratio is 37.5 to 50%, respectively.

7. A phase margin compensation method using an LDO having a phase margin compensation means including a power supply unit, a reference voltage generation unit, a supply voltage output unit, a comparator, and a duty cycle calculator, the phase margin compensation method comprising:

a) outputting voltage (Vout2) by receiving and dropping reference voltage Vref as power from the power supply unit by the reference voltage generation unit;

b) outputting a first reference voltage (Vout1) actually supplied to the target circuit by receiving and dropping the reference voltage Vref as power from the power supply unit by the supply voltage output unit;

first reference voltage (Vout1) output from the supply voltage output unit by the comparator to output a pulse signal according to comparion result of the comparator;

d) receiving an output signal (pulse signal) from the comparator to count any section of the output signal (pulse signal) by a predetermined frequency by the duty cycle calculator, thereby obtaining the duty cycle ratios and output bits according to the counting and duty cycle ratios and output bit information fed back to the supply voltage output unit;

e) controlling a phase margin of a frequency of output voltage supplied to the target circuit by receiving the duty cycle ratios and the output bit information through feedback from the duty cycle calculator by the supply voltage output unit and controlling the buffer current based thereon.

8. The phase margin compensation method according to claim 7, wherein in step d), any section of the output signal (pulse signal) of the comparator by the duty cycle calculator is counted by a predetermined frequency to calculate the number of pulse values that is output as high, the duty cycle ratios are each obtained according to the number of calculated high pulses, and digital bits are each allocated in response to the obtained duty cycle ratios.

9. The phase margin compensation method according to claim 8, wherein the duty cycle ratios are obtained by being divided into 0 to 12.5%, 12.5 to 25%, 25 to 37.5%, and 37.5 to 50% according to the number of calculated high pulses, respectively.

10. The phase margin compensation method according to claim 8, wherein the digital bit is allocated as "00" when the duty cycle ratio is 0 to 12.5%, "01" when the duty cycle ratio is 12.5 to 25%, "10" when the duty cycle ratio is 25 to 37.5%, and "11" when the duty cycle ratio is 37.5 to 50%, respectively.

11. The phase margin compensation method according to claim 7, wherein in step e), the phase margin of the frequency of the output voltage supplied to the target circuit is controlled by feeding back the output bit information from the duty cycle calculator by the supply voltage output unit, setting the corresponding buffer current values according to the output bits, and controlling the buffer current based on each of the set buffer current values.

12. The phase margin compensation method according to claim 11, wherein the buffer current values are set as $I_{buf}$ that is a basic buffer current value when the output bit is "00", $1.5\times I_{buf}$ when the output bit is "01", $2\times I_{buf}$ when the output bit is "10", and $4\times I_{buf}$ when the output bit is "11", respectively.

* * * * *